US010053331B2

(12) United States Patent
Kere

(10) Patent No.: US 10,053,331 B2
(45) Date of Patent: Aug. 21, 2018

(54) ROPE FOR AN ELEVATOR AND METHOD OF CONDITION MONITORING OF THE ROPE

(71) Applicant: KONE Corporation, Helsinki (FI)

(72) Inventor: Petri Kere, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/577,309

(22) Filed: Dec. 19, 2014

(65) Prior Publication Data

US 2015/0191332 A1 Jul. 9, 2015

(30) Foreign Application Priority Data

Jan. 8, 2014 (EP) ..... 14150434

(51) Int. Cl.
*B66B 7/06* (2006.01)
*B66B 7/12* (2006.01)
(Continued)

(52) U.S. Cl.
CPC ..... *B66B 7/062* (2013.01); *B66B 7/1223* (2013.01); *B66B 7/1238* (2013.01); *D07B 1/145* (2013.01); *D07B 1/148* (2013.01); *D07B 1/16* (2013.01); *D07B 1/22* (2013.01); *D07B 2201/2082* (2013.01); *D07B 2201/2093* (2013.01); *D07B 2205/206* (2013.01); *D07B 2205/3007* (2013.01); *D07B 2301/554* (2013.01); *D07B 2301/5581* (2013.01); *D07B 2401/207* (2013.01); *D07B 2501/2007* (2013.01);
(Continued)

(58) Field of Classification Search
CPC ... B66B 7/1238; B66B 7/7123; B66B 7/1223; B66B 7/06; F16G 1/28; F16G 5/20; F16G 5/14; F16G 5/16; F16G 9/02; D07B 1/16; D07B 1/22; Y10T 428/24994; Y10T 428/249942; Y10T 428/249994
See application file for complete search history.

(56) References Cited

U.S. PATENT DOCUMENTS 5,118,559 A * 6/1992 DeVoe ..... C08F 283/12 428/447
5,605,035 A * 2/1997 Pethrick ..... D07B 1/145 116/207
(Continued)

FOREIGN PATENT DOCUMENTS

CN 102985350 A 3/2013
DE 3813338 A1 * 11/1989 ..... B29C 47/0016
(Continued)

*Primary Examiner* — Michael A Riegelman
(74) *Attorney, Agent, or Firm* — Birch, Stewart, Kolasch & Birch, LLP

(57) ABSTRACT

A rope for a hoisting device, in particular for an elevator, includes at least one continuous load bearing member extending in longitudinal direction of the rope throughout the length of the rope, the load bearing member being made of composite material including reinforcing fibers embedded in polymer matrix. The composite material includes capsules embedded in the polymer matrix, the capsules storing monomer substance in fluid form. An elevator includes a rope of the aforementioned kind and a method for condition monitoring of a rope of an elevator.

16 Claims, 3 Drawing Sheets

(51) Int. Cl.
*D07B 1/16* (2006.01)
*D07B 1/14* (2006.01)
*D07B 1/22* (2006.01)

(52) U.S. Cl.
CPC ..... *Y10T 428/24994* (2015.04); *Y10T 428/249942* (2015.04); *Y10T 428/249994* (2015.04)

(56) References Cited

U.S. PATENT DOCUMENTS 5,834,942 A * 11/1998 De Angelis ..... D07B 1/025 187/226
6,327,841 B1 12/2001 Bertini et al.
6,382,080 B1 * 5/2002 De Angelis ..... F15B 15/165 187/274
7,002,079 B2 * 2/2006 Mitchell ..... H01B 17/325 174/137 A
7,022,179 B1 * 4/2006 Dry ..... A61L 27/48 106/677
7,612,152 B2 * 11/2009 Braun ..... B29C 73/163 523/211
7,828,121 B2 * 11/2010 Parrini ..... D07B 1/02 187/251
8,252,411 B2 * 8/2012 Veronesi ..... B66B 7/062 294/74
2001/0050032 A1 * 12/2001 Dry ..... C04B 22/006 106/677
2002/0111434 A1 8/2002 White et al.
2003/0011483 A1 * 1/2003 Lamb ..... B66B 7/1223 340/664
2003/0062225 A1 * 4/2003 Stucky ..... B66B 7/123 187/393
2008/0003430 A1 * 1/2008 Wilson ..... D01D 4/02 428/375
2009/0015272 A1 1/2009 Jones et al.
2009/0078922 A1 * 3/2009 Kempf ..... D07B 1/025 254/266
2010/0133046 A1 6/2010 Allwardt et al.
2011/0000746 A1 * 1/2011 Pelto-Huikko ..... B66B 7/062 187/254
2011/0172932 A1 * 7/2011 Bachmann ..... B66B 7/1215 702/34
2011/0259677 A1 10/2011 Dudde et al.
2013/0206516 A1 8/2013 Pelto-Huikko et al.
2013/0237354 A1 * 9/2013 Shiriike ..... F16G 5/06 474/148
2014/0302316 A1 * 10/2014 Gallens ..... B66B 7/062 428/379

FOREIGN PATENT DOCUMENTS

RU 2005 110 780 A 10/2006
WO WO 2009/090299 A1 7/2009

* cited by examiner

ROPE FOR AN ELEVATOR AND METHOD OF CONDITION MONITORING OF THE ROPE

FIELD OF THE INVENTION

The invention relates to a rope of a hoisting device, in particular to a rope of an elevator, the elevator being in particular an elevator for transporting passengers and/or goods.

BACKGROUND OF THE INVENTION

Elevators typically have ropes used for suspending the elevator car. Often, they also comprise a counterweight suspended by the same ropes as the elevator car. The ropes are provided with one or more load bearing members that bear the weight of the load suspended by the ropes. The ropes may be round in cross section or belt-shaped. The round ropes generally comprise only one load bearing member, whereas belt-shaped ropes generally comprise one wide load bearing member or several load bearing members spaced apart in the width direction of the rope. A load bearing member is conventionally a bundle of steel wires twisted together but also load bearing members made of fiber-reinforced composite material exist. Document WO2009090299A1 discloses one recently developed structure for load bearing member of this kind.

An elevator rope may get damaged during its use for various reasons. The damaging is generally caused by common wear, but unpredictable events may occur in the elevator environment as well. A problem is that a damage, normally very small at first, easily expands and eventually requires that the ropes are replaced. For the rope is determined a safe service life, measured e.g. in time of use or in amount of use, which is chosen so that dangerous damages are not likely to be formed within the service life of the rope. A drawback with any rope according to prior art is that eventually they need to be replaced. In particular, replacement of ropes earlier than scheduled, causes costs, whereby this should be avoided. Ropes having load bearing parts made of fiber-reinforced composite material have a long service life, but the ropes being valuable, it would be preferable if the service life could be even longer.

BRIEF DESCRIPTION OF THE INVENTION

The object of the invention is to introduce a rope for a hoisting device, which is improved in terms of rope damage control, in particular a rope for an elevator as safety and service life of a rope are especially important in elevators. The object of the invention is furthermore to introduce an elevator and a method which are improved in terms of rope damage control. An object of the invention is, inter alia, to solve previously described drawbacks of known solutions and problems discussed later in the description of the invention. Particularly, an object of the invention is to extend endurance of elevator ropes. Embodiments are presented, inter alia, which facilitate postponing replacement of used ropes, possibly even completely avoiding replacing of used ropes earlier than scheduled/expected. Embodiments are presented, inter alia, which facilitate rope condition monitoring and maintenance.

It is brought forward a new rope for an elevator comprising at least one continuous load bearing member extending in longitudinal direction of the rope throughout the length of the rope, the load bearing member being made of composite material comprising reinforcing fibers embedded in polymer matrix. The composite material comprises capsules embedded in said polymer matrix, the capsules storing monomer substance in fluid form. This makes it possible that ruptures forming in the rope during its use are constantly repaired by a self-healing process. In this self-healing process the monomer escapes from the capsules into the rupture where it polymerizes. Thereby, expansion of the rupture from micro-scale to macro-scale can be slowed down or even completely stopped. Thereby, the service life/endurance of the rope can be increased. Each of said capsules comprises walls delimiting a closed hollow inside space, wherein said monomer substance is stored, each capsule encapsulating the monomer substance leak-proofly when the wall of the capsule is intact.

In a further refined embodiment, the capsules are distributed substantially evenly in the composite material. Thus, the self-healing ability is evenly realized in all parts of the load bearing member. Also, thus the load bearing ability of the load bearing member is minimally affected by the capsules.

In a further refined embodiment, the composite material comprises optical indicator substance in fluid form, stored in capsules embedded in said polymer matrix, the optical indicator substance being substantially different in its optical properties from the optical properties of the matrix and/or the reinforcing fibers. The indicator substance being in fluid form makes it able to flow out of the capsule in which it is stored and spread in the load bearing member if a rupture formed in the load bearing member reaches and breaks the capsule. The optical properties are suitable to indicate where the substance(s) have been spread inside the load bearing member. Thus, by carrying out an optical analysis a location of rupture can be found. The capsules storing the optical indicator substance are preferably the same capsules as the ones storing the monomer substance. The indicator substance and the monomer substance are in this case preferably mixed with each other and the mixture of the optical indicator substance and the monomer substance is substantially different in its optical properties from the optical properties of the matrix and/or the reinforcing fibers.

In a further refined embodiment, the optical indicator substance is substantially different in one or more of its fluorescence, color and contrast from the same of the material of the matrix and/or the reinforcing fibers at least when it has leaked from a ruptured capsule and spread across the load bearing member in ruptures of the load bearing member. The optical indicator substance is suitable for optically indicating where the material from the capsule has spread, and thus also to indicate the shape and size of the rupture.

In a further refined embodiment, the optical indicator substance is fluorescent and sensitive to ultraviolet radiation. Thus, even very small ruptures can be identified.

In a further refined embodiment, the said at least one load bearing member is embedded in transparent coating forming the surface of the rope, the surface of the at least one load bearing member being visible through said transparent coating. Thus, the surface of the at least one load bearing member is visible through said transparent coating, whereby optical (e.g. visual) inspection of the load bearing member(s) of the rope is possible. An advantage is that the results of the self-healing process can be confirmed optically.

In a further refined embodiment, each capsule storing the optical indicator substance comprises walls delimiting a closed hollow inside space, wherein the optical indicator substance is stored.

In a further refined embodiment, the capsules are in the form of hollow fibers storing the monomer material in a hollow inside space.

In a further refined embodiment, the composite material further comprises catalyst substance for triggering and/or accelerating polymerization reaction of the monomer substance when in contact with it. The catalyst substance is among the polymer matrix material. Thus, the monomer substance can get into contact with it by flowing in the rupture. As regards to constitution of the catalyst substance, it is preferable that it comprises ruthenium. Generally, it may comprise transition metal carbene complexes (Grubbs' catalysts).

In a further refined embodiment, the walls of the capsules comprise urea-formaldehyde. This material is one well working material for the walls of the capsule.

In a further refined embodiment, the capsules encapsulate the indicator substance leak-proofly when the wall of the capsule is intact.

In a further refined embodiment, the monomer substance comprises dicyclopentadiene (DCPD). Dicyclopentadiene is one well working material in this context.

In a further refined embodiment, the load bearing member is parallel with the longitudinal direction of the rope.

In a further refined embodiment, the reinforcing fibers are nonmetallic fibers.

In a further refined embodiment, the reinforcing fibers are carbon fibers. Thus, a light-weight rope with very high load bearing ability as well as very long service life can be achieved.

In a further refined embodiment, the polymer matrix comprises epoxy.

In a further refined embodiment, the reinforcing fibers are parallel with the longitudinal direction of the rope. Thus, a maximal stiffness for the load bearing member as well as for the rope is achieved, whereby the rope is well suitable for use as a hoisting rope.

In a further refined embodiment, the reinforcing fibers are continuous fibers, extending substantially throughout the whole length of the rope.

In a further refined embodiment, the capsules are in the form of hollow fibers and oriented parallel with the reinforcing fibers.

In a further refined embodiment, the capsules in the form of hollow fibers are short fibers, in particular shorter than the reinforcing fibers. Thus, they can be manufactured and mixed among the matrix, and among the longer reinforcing fibers easily and evenly. In particular, thus the load bearing ability of the load bearing member is not at risk.

In a further refined embodiment, the said at least one load bearing member is embedded in elastomeric coating forming the surface of the rope.

In a further refined embodiment, the rope comprises plurality of said load bearing members.

In a further refined embodiment, the rope is belt-shaped.

In a further refined embodiment, the rope is belt-shaped, having a width substantially larger than width in transverse direction of the rope, and comprises plurality of said load bearing members adjacently and spaced apart in width direction of the rope.

It is also brought forward a new elevator, such as a traction wheel elevator, comprising an elevator car and a roping comprising one or more ropes connected to the car, in particular to suspend the elevator car. The rope is as described above. Thus, one or more of the above given advantages are achieved. In particular, an elevator is achieved with a long service life without rope replacements.

In a further refined embodiment, said at least one load bearing member forms part of an electrical circuit, and the reinforcing fibers are electrically conducting fibers, such as carbon fibers, whereby the load bearing part is electrically conducting, and the elevator comprises a rope condition monitoring device, arranged to monitor one or more electrical property of said circuit, preferably the electrical resistance of the circuit, and if a predefined electrical property, such as said resistance, exceeds a predetermined limit, a predetermined action is arranged to be initiated. The action to be initiated preferably comprises locating point(s) of rupture in the rope and inspecting the condition of the rope at the point(s) of rupture. Thus, rupturing and the success of the self-healing process can be noticed and verified. Such action may alternatively or additionally comprise braking of the safety circuit of the elevator, whereby safety of the elevator can be ensured until the state of the ropes is checked.

It is also brought forward a new method for condition monitoring of a rope of an elevator comprising an elevator car and a rope connected to the elevator car, which elevator is as defined in any of the preceding claims. The method comprises locating point(s) of rupture in the rope and inspecting the condition of the rope at the point(s) of rupture. Preferably, the point(s) of rupture in the rope is/are located by identifying point(s) with deviating optical properties, i.e. point(s) with optical properties substantially deviating from the optical properties of the rest of the rope.

In a further refined embodiment, point(s) of rupture in the rope is/are located by identifying peak(s) in occurrence of the optical indicator substance.

In a further refined embodiment, point(s) of rupture in the rope is/are located visually or by aid of optical means.

In a further refined embodiment, said at least one load bearing member forms part of an electrical circuit, and one or more predefined electrical property of said circuit, preferably the electrical resistance of the circuit, is monitored and if a predefined electrical property, such as said resistance, exceeds a predetermined limit, said locating and inspecting are carried out. Thus, changes in the state of the rope can be noticed. Thereafter, possible occurrence of rupturing and the success of subsequent self-healing process can be verified.

In a further refined embodiment, the optical indicator substance is fluorescent and sensitive to ultraviolet radiation, and the rope is radiated with ultraviolet radiation for making the fluorescent substance better visible. The point(s) of rupture in the rope is/are located by identifying point(s) with deviating optical properties, i.e. point(s) with optical properties substantially deviating from the optical properties of the rest of the rope. In this case, the point(s) of rupture in the rope is/are located by identifying peak(s) in occurrence of the optical indicator substance especially by identifying point(s) where the light emitted by the rope peaks.

The elevator is preferably installed inside a building, such as a tower building. The elevator is preferably of the type where its car is arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, whereby safe transport of passengers is ensured.

BRIEF DESCRIPTION OF THE DRAWINGS

In the following, the present invention will be described in more detail by way of example and with reference to the attached drawings, in which.

DETAILED DESCRIPTION

Figure 1:
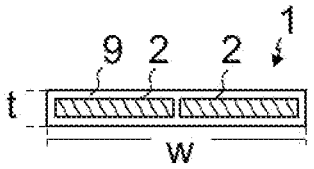
FIG. 1 illustrates a cross-section of a rope according to a preferred embodiment.
Figure 2:
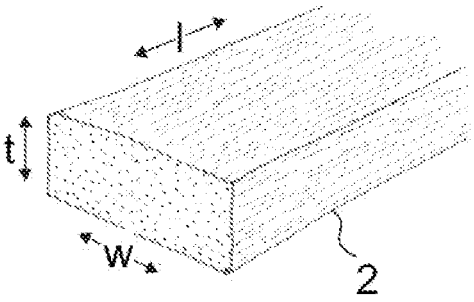
FIG. 2 illustrates three-dimensionally a load bearing member of the rope illustrated in FIG. 1.
Figure 5:
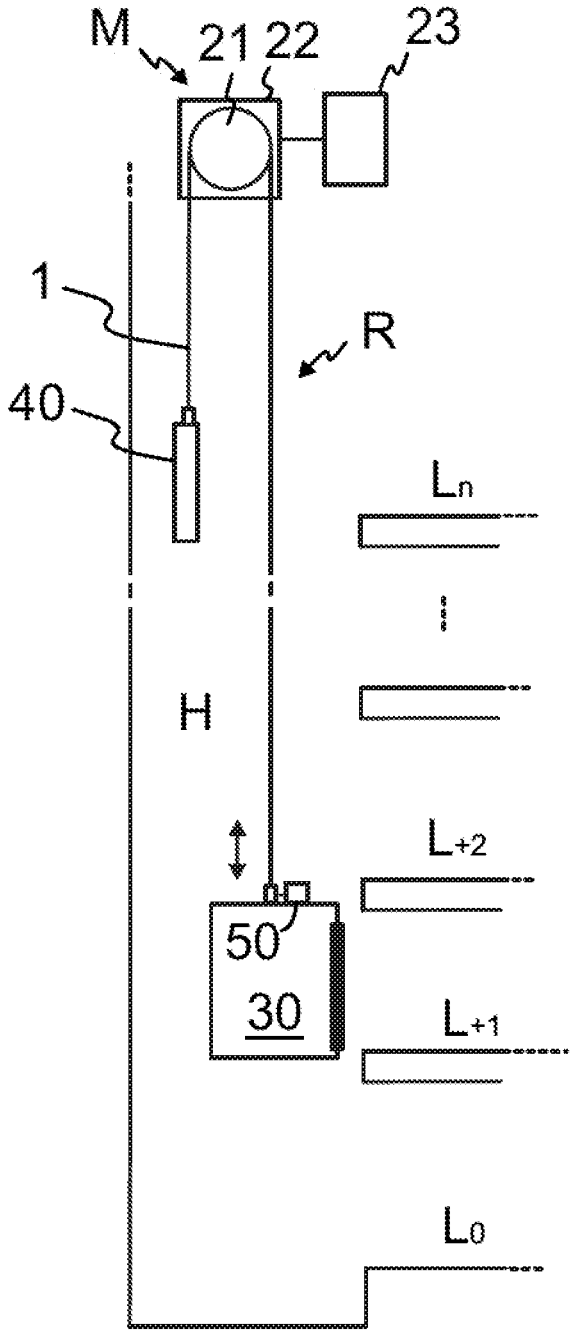
FIG. 5 illustrates an elevator according to a preferred embodiment.

FIG. 1 illustrates a cross section of a rope 1 for hoisting device, in particular for an elevator. The rope 1 comprises a continuous load bearing member 2 extending in longitudinal direction l of the rope 1 throughout the length of the rope 1. The load bearing member 2 is made of composite material comprising reinforcing fibers f embedded in polymer matrix m. With this material selection the rope 1 can be formed light-weight and provided with a good longitudinal stiffness and tensile strength. The load bearing member 2 is illustrated in FIG. 2 as such. The rope 1 is preferably belt-shaped, and has thereby a width w substantially larger than thickness t thereof as viewed in transverse direction of the rope 1. FIG. 1 illustrates the rope 1 having a plurality, in this case two, of said load bearing members 2 adjacent in width direction of the rope 1. However, the rope 1 can alternatively be designed to have only one of said load bearing members 2 or more than two load bearing members 2 adjacent in width direction of the rope 1. In this embodiment, the load bearing members 2 are embedded in elastomeric coating 9 forming the surface of the rope 1. Such a coating 9 protects the load bearing members 2 and provides the rope a high friction surface via which force can be transmitted by frictional engagement to the rope, e.g. by a traction wheel 21 as illustrated in FIG. 5.

Figure 3:
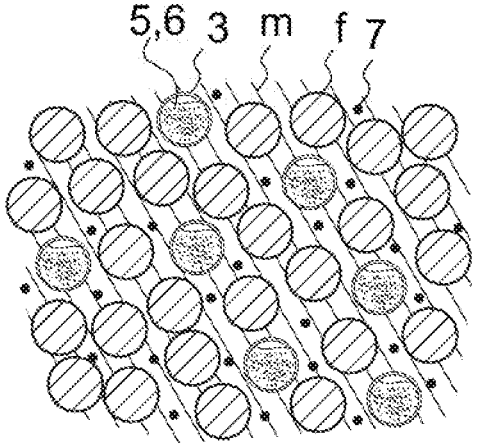
FIG. 3 illustrates a partial cross-section of the load bearing member illustrated in FIG. 2.
Figure 4:
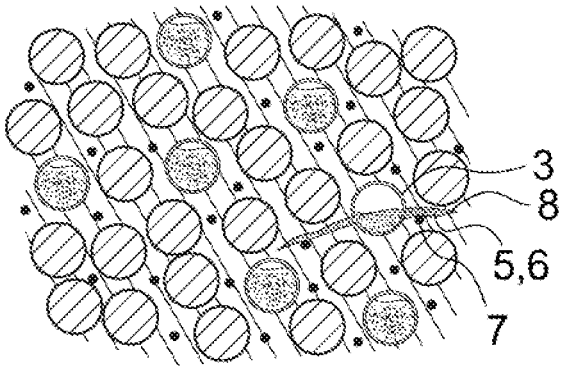
FIG. 4 illustrates a partial cross-section of the load bearing member illustrated in FIG. 2 when a rupture has emerged in the composite material.

FIG. 3 illustrates an enlarged view of the cross section of a portion of the load bearing member 2 as viewed in longitudinal direction of the load bearing member 2. The composite material comprises capsules 3 embedded in said polymer matrix m, the capsules 3 storing monomer substance 4 in fluid form. The monomer substance 4 being in fluid form makes it easily spreading if it leaks out of the capsule in case the capsule 3 is ruptured as a result of a rupture in the material of the load bearing member 2. FIG. 4 illustrates a situation where a small rupture is formed in the load bearing member 2. When a small rupture is formed in the load bearing member 2 at least some of the capsules 3 embedded in the solid matrix m get eventually ruptured as well. As a result, the monomer substance 4 is free to leak out of the capsule 3 into the rupture. The substance 4 leaked into the rupture is monomer substance, whereby it bonds with the walls of the rupture, in particular with the polymer matrix m, thereby forming a glue between the opposite walls of the rupture and filling the rupture. Thus, the rupture is stopped from expanding. In this way, ruptures can be stopped, when they are still small, from expanding to a scale beyond repair. For ensuring repair of ruptures in any location of the load bearing member 2, the capsules 3 are distributed substantially evenly in the polymer matrix m.

The capsules are preferably such that each of them comprises walls delimiting a closed hollow inside space, wherein said monomer is stored. The shape of the capsule is preferably elongated, the capsules most preferably being in the form of hollow fibers storing the monomer material in a hollow inside space. Thereby, they settle interlaced between the reinforcing fibers f of the composite material. In particular, they can thus be parallel with the reinforcing fibers f. Elongated shape, and especially fiber-like shape provides for that the total volume of all the capsules 3 can be easily distributed evenly along the length of the load bearing part 2. Thus, the complete length of the load bearing member 2 can effectively be provided with the self-healing ability without excessive total volume consumed by the capsules.

The monomer material preferably is or at least comprises dicyclopentadiene (DCPD). This monomer substance is one well working example, but alternatively any other monomer substance having an ability of polymerizing as such when contact with the matrix m or together with a catalyst, can be used. The walls of the capsules may be any suitable material, but preferably they comprise urea-formaldehyde, which is well suitable for storing the monomer substance yet being likely to rupture sufficiently easily in case the rupture in the composite material reaches the capsule 3.

So as to ensure that the monomer substance stays reactive after manufacturing the load bearing member 2 and/or to ensure that the monomer substance 4 escapes the capsule only in case of need, the capsules 3 encapsulate the monomer substance 4 in a leak-proof manner, i.e. when the walls of the capsule are intact.

For triggering and/or accelerating polymerizing reaction of the monomer substance 3, the composite material further comprises catalyst material 7 for triggering and/or accelerating polymerization reaction of the monomer substance 4, when it gets in contact with the catalyst material 7. The catalyst material 7 preferably comprises metal carbene complexes (Grubbs' catalysts). Preferably it comprises ruthenium. The catalyst material is among the polymer matrix m, preferably dispersed evenly or embedded as agglomerates in the polymer matrix m. FIGS. 3 and 4 illustrate the catalysts 7. Should it be that there's a need for increasing the effect of the catalyst 7 then a denser and/or more even distribution of the catalyst 7 is preferable (than what is presented in FIGS. 3 to 4). In that case, the catalyst is preferable to divide into smaller agglomerates than presented or alternatively dispersed evenly in the matrix m.

FIG. 4 illustrates the load bearing member 2 when a rupture 8 has been formed in it, and the monomer substance 5 has leaked from capsule 3 ruptured as well, and spread across the load bearing member 2 in the rupture 8 of the load bearing member 2. The monomer substance has also reached the catalyst 7.

The reinforcing fibers f are preferably continuous fibers, extending substantially throughout the whole length of the load bearing member 2. Thus, the load bearing ability of the load bearing member 2 is increased. The capsules 3, which are in the preferred embodiment in the form of hollow fibers, are substantially shorter fibers than the reinforcing fibers f. Thus, they can be manufactured and mixed among the matrix m, and among the longer reinforcing fibers f easily and evenly.

The reinforcing fibers f are preferably nonmetallic fibers, whereby a light-weight rope can be formed. In the preferred embodiment, the reinforcing fibers f are carbon fibers. Thus, a light-weight rope 1 with very high load bearing ability can be achieved.

In the preferred embodiment, each of said load bearing members 2 is parallel with the longitudinal direction of the rope. Also, the reinforcing fibers f are parallel with the longitudinal direction of the rope 1. Thus, the load bearing properties, in particular longitudinal stiffness and tensile strength of the rope are maximized. Furthermore, the capsules 3, which in the form of hollow fibers are oriented parallel with the reinforcing fibers f. Thereby, they fit and settle well interlaced between the reinforcing fibers f of the composite material. The total volume of all the capsules 3 can thus also be easily distributed evenly along the length of the load bearing part 2.

In the preferred embodiment, the composite material comprises capsules 3 embedded in said polymer matrix m, which capsules 3 store optical indicator substance 6, the optical indicator substance 6 being substantially different in its optical properties from the optical properties of the matrix m and/or the reinforcing fibers f. In the preferred embodiment, the capsules storing the optical indicator substance 6 are the same capsules as the ones storing the monomer substance 5. The indicator substance 6 and the monomer substance 5 are in this case mixed with each other and thereby presented as one. The mixture of the optical indicator substance 6 and the monomer substance 5 is then substantially different in its optical properties from the optical properties of the matrix m and/or the reinforcing fibers f. Although preferable for the purpose of indicating the ruptures optically, presence of the optical indicator substance 6 is of course not necessary for the self-healing to be realized. Should the indicator substance 6 be omitted from among the materials stored by the capsules 3, the configuration would not need to change from what is illustrated in Figures. Also, it is of course one possible alternative that said the indicator substance 6 and the monomer substance 5 are stored in different capsules, in which case they would be completely separate fluid materials.

The purpose of the indicator substance 6 is to indicate where the substance(s) 5,6 have spread inside the load bearing member 2. For facilitating the spreading, the optical indicator substance 6 is as well in fluid form. The optical indicator substance 6 being substantially different in its optical properties from the optical properties of the matrix m and/or the reinforcing fibers f, it can be identified among the material surrounding it. Thus, by carrying out optical analysis a location of rupture can be found.

The optical indicator substance 6 is, in particular, substantially different in one or more of its fluorescence, color and contrast from that of the material of the matrix m and/or the reinforcing fibers f at least when it has leaked from a ruptured capsule 3 and spread across the load bearing member 2 in rupture(s) thereof. The indicator substance 6 can be given a specific color by pigments, for instance. The pigments may be organic or alternatively inorganic. The pigments may include for instance titanium dioxide, zinc sulphide, iron oxide, cadmium compounds, chrome yellow or flakes of zinc aluminium, copper or nickel.

For facilitating the finding of the rupture 8 by using optical analysis, the load bearing member(s) 2 of the rope 1 is/are embedded in transparent coating 9 forming the surface of the rope 1. The surface of the at least one load bearing member 2 is visible through said transparent coating 9, whereby visual inspection of the load bearing member(s) 2 of the rope 1 is possible.

The rope 1 as described and illustrated is preferably a rope of an elevator. FIG. 5 illustrates an elevator according to a preferred embodiment. The elevator is in this case a traction wheel elevator, comprising an elevator car 30 and a roping R comprising one or more ropes 1 connected to the car 30, in particular to suspend the elevator car 30. The rope 1 is as described and illustrated elsewhere. The elevator is in this case provided with several landings $L_0$ to $L_n$ served by the elevator car 1. The elevator furthermore comprises a hoistway H, wherein the elevator car 1 and a counterweight 40 connected to the car 1 by the ropes 1 of the roping R, are vertically movable. The elevator comprises a drive machine M which drives the elevator car 30 under control of an elevator control system 23. The drive machine M comprises a motor 2 and a traction sheave 21 engaging elevator ropes 1 passing around it, preferably frictionally. Thus, driving force can be transmitted from the motor to the car 1 via the traction sheave 21 and the ropes 1.

Figure 6:
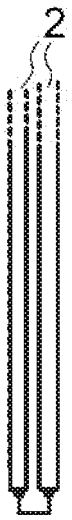
FIGS. 6 and 7 illustrate opposite ends of two load bearing members each forming a part of an electrical circuit that is being monitored.
Figure 7:
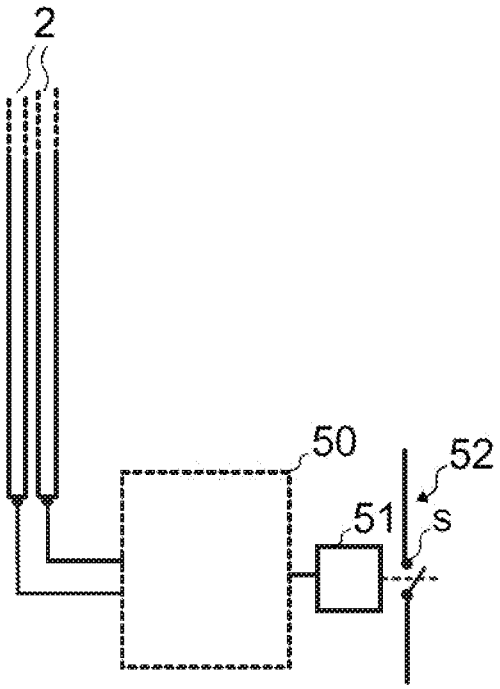

The elevator is preferably provided with a condition monitoring device 50 for monitoring condition of the ropes 1. FIGS. 5 to 7 illustrate the configuration of the condition monitoring device 30. In this configuration, a condition monitoring device 50 is connected to load bearing members 2 each forming part of an electrical circuit, and the reinforcing fibers f are electrically conducting fibers, preferably carbon fibers, whereby the load bearing part 2 is electrically conducting. In this configuration, condition monitoring device 50 is arranged to monitor one or more electrical property of said circuit, most preferably the electrical resistance of the circuit. A predefined change in electrical property, such as said resistance, is thereby interpreted as a sign of reduced condition of the rope 1. In particular, increase of resistance is likely a result of rupturing of the load bearing member 2. Thereby, based on the change in a monitored electrical property of the load bearing member 2 it can be deduced whether it has ruptured. If a predefined electrical property, such as said resistance, changed in a predetermined way, such as exceeds a predetermined limit, a predetermined action is arranged to be initiated. For carrying out the monitoring actions, and determination whether a limit is exceeded, as well as for initiating predetermined actions, the monitoring device comprises suitable means, such as a processor and a memory, but any other suitable means may be used. The action to be initiated preferably comprises locating point(s) of rupture in the rope 1 and inspecting the condition of the rope 1 at the point(s) of rupture. Thus, rupturing and the success of the self-healing process can be verified. Such action may alternatively or additionally comprise braking of the safety circuit 52 of the elevator. As illustrated in FIG. 7, the elevator preferably comprises a safety circuit 52. The condition monitoring device 50 is in this case configured to brake the safety circuit 52 of the elevator if the predefined electrical property, such as said resistance, exceeds a predetermined limit. Breaking of the safety circuit 52 is arranged to cause braking of rotation of the traction sheave 21 and/or to stop rotating the traction sheave 21. Thereby, should the electrical properties of the load bearing member(s) change in a predetermined manner, the elevator is brought into safe state by stopping the movement of the car immediately. Safety circuit (also known as safety chain) is a known feature of an elevator and it is thereby not described more specifically here. The condition monitoring device 50 is in the preferred embodiment arranged to control a safety relay 51, controllable to break a safety switch s of the safety circuit. There may be several of said limits, in particular one for each of the mentioned actions a different limit. Then, in particular, the limits are chosen such that the inspection is triggered more easily than breaking of the safety circuit 52. Thus, the self healing process, as well as the inspection steps, take place while the condition of the rope 1 has not decreased to an unsafe level.

In a preferred embodiment of a method according to the invention condition of a rope 1 of an elevator is monitored. The rope 1 as well as the elevator is described above and illustrated in FIGS. 1 to 7. The method comprises locating point(s) of rupture in the rope 1 and inspecting the condition of the rope 1 at the point(s) of rupture. Thus, rupturing of the rope 1 and the success of the self-healing process can be verified. Thereby, decisions about the following steps can be based on verified condition of the rope 1. For instance, the point of rupture 8 can thus be inspected thoroughly. For example, an ultasonography analysis can be carried out so as to inspect whether the ropes 1 need to be replaced.

As above described, the rope 1 is such that it comprises a load bearing member 2 extending in longitudinal direction of the rope 1 throughout the length of the rope 1, the load bearing member 2 being made of composite material comprising reinforcing fibers f embedded in polymer matrix m, and the composite material comprises capsules 3 embedded in said polymer matrix m, the capsules storing monomer substance 4 in fluid form.

For facilitating identifying point(s) of rupture 8 in the rope 1, the composite material may comprise, as also above explained, capsules embedded in said polymer matrix m which are in the illustrated case the same capsules 3 as the capsules 3 storing the monomer substance 5, storing optical indicator substance 6 in fluid form. The optical indicator substance 6 is substantially different in its optical properties from the optical properties of the matrix and/or the reinforcing fibers, whereby it indicates optically the rupture 8, when leaked out from its capsule 3. The substances 5 and 6 being stored in the same capsules, results in that they flow into same parts of the same rupture 8, whereby indicator substance 6 indicates where the monomer substance 5 has spread in the composite material. In the method point(s) of rupture in the rope 1 is/are located by identifying point(s) with deviating optical properties. This is carried out preferably by identifying peak(s) in optical indicator substance 6. Then, point(s) of rupture 8 in the rope 1 is/are located visually or by aid of optical means, such as a camera or a light source. The light source may be one with a wavelength suitable for making the indicator substance, in case it is fluorescent, to emit radiation. Preferably, the optical indicator substance is fluorescent and sensitive to ultra-wave radiation, i.e. emits visible light when under radiation in the ultraviolet region, in particular in the range between 400 nm and 10 nm. Thereby, it is easy to differentiate even small amounts of optical indicator substance, such as by inspecting with a bare eye or with a camera. Thus, very small ruptures 8 can be identified. Identifying the point of rupture 8 may be important not only for determining whether ropes 1 can be still used but also for the determination of the cause of the rupture 8 during analysis of the operating conditions of the rope 1. When the optical indicator substance is fluorescent and sensitive to ultraviolet radiation, and the rope is radiated with ultraviolet radiation. The point(s) of rupture 8 in the rope 1 is/are then located by identifying point(s) with deviating optical properties, in this case, the point(s) of rupture 8 in the rope 1 is/are located by identifying peak(s) in occurrence of the optical indicator substance especially by identifying point(s) where the light emitted by the rope 1 peaks.

It is preferable that in the method one or more predefined electrical property of said circuit formed at least partially by a load bearing member 2, preferably the electrical resistance of the circuit, is monitored and if a predefined electrical property of the circuit, such as said resistance of the circuit, is changed in a predetermined way, a predetermined action is arranged to be initiated. Such an action preferably includes that said locating and inspecting are carried out. In this embodiment, the reinforcing fibers f are electrically conducting fibers, preferably carbon fibers, which are best suitable for the purpose in terms of electrical conductivity and suitability for load bearing function. With electrical condition monitoring, the condition of the rope 1 is possible to be checked triggered by a change in the property of the circuit. In particular, if resistance of the circuit exceeds a predetermined limit, said locating and inspecting are carried out.

Such action may alternatively or additionally comprise braking of the safety circuit 52 of the elevator. The condition monitoring device 50 is in this case configured to brake the safety circuit 52 of the elevator if the predefined electrical property such as said resistance, changes in a predetermined way, such as exceeds a predetermined limit. Breaking of the safety circuit 52 is arranged to cause braking of rotation of the traction sheave 21 and/or to stop rotating the traction sheave 21. Thereby, should the electrical properties of the load bearing member(s) change in a predetermined manner, the elevator is brought into safe state by stopping the movement of the car immediately. There may be several of said limits, in particular one for each of the mentioned actions a different limit. Then, in particular, the limits are chosen such that the inspection is triggered more easily than breaking of the safety circuit 52. Thus, the self-healing process, as well as the inspection step, take place while the condition of the rope 1 has not decreased to an unsafe level.

The preferred composite structure of the load bearing member 2 is preferably more specifically as follows. The load bearing member 2, as well as its fibers f are parallel with the longitudinal direction the rope, and untwisted as far as possible. Individual reinforcing fibers f are bound into a uniform load bearing member with the polymer matrix m. Thus, each load bearing member 2 is one solid elongated rodlike piece. The reinforcing fibers f are preferably long continuous fibers in the longitudinal direction of the rope 1 the fibers f preferably continuing for the whole length of the load bearing member 2 as well as the rope 1. Preferably as many fibers f as possible, most preferably substantially all the fibers f of the load bearing member 2 are oriented parallel with the rope, as far as possible in untwisted manner in relation to each other. Thus the structure of the load bearing member 2 can be made to continue the same as far as possible in terms of its cross-section for the whole length of the rope. The reinforcing fibers f are preferably distributed in the aforementioned load bearing member 2 as evenly as possible, so that the load bearing member 2 would be as homogeneous as possible in the transverse direction of the rope. An advantage of the structure presented is that the matrix m surrounding the reinforcing fibers f keeps the interpositioning of the reinforcing fibers f substantially unchanged. It equalizes with its slight elasticity the distribution of a force exerted on the fibers, reduces fiber-fiber contacts and internal wear of the rope, thus improving the service life of the rope. The composite matrix m, into which the individual fibers f are distributed as evenly as possible, is most preferably of epoxy resin, which has good adhesiveness to the reinforcement fibers f and which is known to behave advantageously with carbon fiber. Alternatively, e.g. polyester or vinyl ester can be used, but alternatively any other suitable alternative materials can be used. FIGS. 3 and 4 present a partial cross-section of the load bearing member as viewed in the longitudinal direction of the rope, according to which cross-section the reinforcing fibers f of each load bearing member 2 are preferably organized in the polymer matrix m. The rest (not showed parts) of the load bearing member 2 has a similar structure. As presented, individual reinforcing fibers f are substantially evenly distributed in the polymer matrix m, which surrounds the fibers bonded to the fibers f. The polymer matrix m fills the areas between individual reinforcing fibers f and binds substantially all the reinforcing fibers f that are inside the matrix m to each other as a uniform solid substance. A chemical bond exists between, preferably all, the individual reinforcing fibers f and the matrix m, one advantage of which is uniformity of the structure. To strengthen the chemical bond, there can be, but not necessarily, a coating (such as sizing, not presented) of the actual fibers between the reinforcing fibers and the polymer matrix m. The polymer matrix m is preferably of a hard non-elastomer. It can comprise additives for fine-tuning the properties of the matrix as an addition to the base polymer. The reinforcing fibers f being in the polymer matrix means here that the individual reinforcing fibers f are bound to each other with the polymer matrix m, e.g. in the manufacturing phase by immersing them together in the fluid material of the polymer matrix m. In this case the gaps of individual reinforcing fibers f bound to each other with the polymer matrix m comprise the polymer of the matrix. In this way a great number of reinforcing fibers bound to each other in the longitudinal direction of the rope are distributed in the polymer matrix. The reinforcing fibers f are preferably distributed substantially evenly in the polymer matrix such that the load bearing member is as homogeneous as possible when viewed in the direction of the cross-section of the rope. In other words, the fiber density in the cross-section of the load bearing member does not therefore vary substantially. The reinforcing fibers f together with the matrix m form a uniform load bearing member, inside which abrasive relative movement does not occur when the rope is bent. The individual reinforcing fibers f and the capsules 3 of the load bearing member 2 are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the invention. If, however, it is desired to reduce their random occurrence, the individual reinforcing fibers f can be precoated such that a polymer coating is around them already before the binding of individual reinforcing fibers to each other. In the invention the individual reinforcing fibers of the load bearing member can comprise material of the polymer matrix around them such that the polymer matrix is immediately against the reinforcing fiber but alternatively a thin coating, e.g. a primer arranged on the surface of the reinforcing fiber in the manufacturing phase to improve chemical adhesion to the matrix material, can be in between. Individual reinforcing fibers are distributed evenly in the load bearing member 2 such that the gaps of individual reinforcing fibers f are filled with the polymer of the matrix m. Most preferably the majority, preferably substantially all of the gaps of the individual reinforcing fibers f in the load bearing member 2 are filled with the polymer of the matrix m. As above mentioned, the matrix m of the load bearing member 2 is most preferably hard in its material properties. A hard matrix m helps to support the reinforcing fibers f, especially when the rope bends, preventing buckling of the reinforcing fibers f of the bent rope, because the hard material supports the fibers f. To reduce the buckling and to facilitate a small bending radius of the rope, among other things, it is therefore preferred that the polymer matrix is hard, and in particular non-elastomeric. The most preferred materials are epoxy resin, polyester, phenolic plastic or vinyl ester. The polymer matrix is preferably so hard that its module of elasticity (E) is over 2 GPa, most preferably over 2.2 GPa. In this case the module of elasticity (E) is preferably in the range 2.2-10 GPa, most preferably in the range 2.2-3.2 GPa. There are commercially available various material alternatives for the matrix m which can provide these material properties. Preferably over 40% of the surface area of the cross-section of the load bearing member 2 is of the aforementioned reinforcing fiber, preferably such that 40%-80% is of the aforementioned reinforcing fiber f, more preferably such that 40%-70% is of the aforementioned reinforcing fiber, and a major proportion of the remaining surface area is of polymer matrix m and a minor proportion of the capsules 3. Most preferably, this is carried out such that approx. 60% of the surface area is of reinforcing fiber and approx. at least 35% is of matrix material (preferably epoxy material). In this way a good longitudinal stiffness for the load bearing member 2 as well as good electrical conductivity are achieved.

In this application, the term load bearing member 2 of a rope 1 refers to a member that extends in longitudinal direction of the rope 1 throughout the length of the rope 1. When the rope is pulled, e.g. by the load being suspended by the rope, tension produced by the pull can be transmitted inside a load bearing member 2 all the length thereof, in particular from one end of the load bearing member to the other end of it.

As mentioned, the number and the shape of the load bearing members 2 could be different than what is illustrated in FIG. 1. As an alternative to the cross section illustrated in FIG. 1, the rope 1 may have a cross sectional outer shape and/or load bearing member(s) with cross sectional shape(s) as illustrated in international patent application WO2009090299A1.

As mentioned, for facilitating its spreading, the optical indicator substance 6 is in fluid form. The fluidic state can be provided for the optical indicator substance 6 in various ways. In the preferred embodiment, the indicator substance 6 and the monomer substance 5 are mixed with each other. The fluidic state of the optical indicator substance 6 can then be at least partially provided by the monomer substance 5

It is to be understood that the above description and the accompanying figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. A rope for a hoisting device comprising:

at least one continuous load bearing member extending in longitudinal direction of the rope throughout the length of the rope, the load bearing member being made of composite material comprising reinforcing fibers embedded in a polymer matrix, wherein substantially the entirety of the at least one continuous load bearing member is parallel with the longitudinal direction of the rope and is untwisted and substantially the entirety of the reinforcing fibers are parallel with the longitudinal direction of the rope and are untwisted, wherein the composite material comprises capsules embedded in said polymer matrix, the capsules storing a monomer substance in fluid form, each capsule comprising a wall delimiting a closed, hollow inside space in which said monomer substance is stored, each capsule encapsulating the monomer substance in a leakproof manner when the wall of the capsule is intact, wherein an optical indicator substance in fluid form is stored in said capsules and mixed with the monomer substance, the optical indicator substance being substantially different in its optical properties from the optical properties of the polymer matrix and/or the reinforcing fibers, wherein the optical indicator substance is fluorescent and sensitive to ultraviolet radiation, wherein the wall of the capsules comprises urea-formaldehyde, wherein the capsules are shaped elongated and parallel with the reinforcing fibers, wherein said at least one load bearing member forms part of an electrical circuit, and the reinforcing fibers are electrically conducting fibers, whereby the load bearing member is electrically conducting, and wherein the at least one load bearing member is configured to be electrically connected to a rope condition monitoring device of an elevator that monitors one or more electrical properties of the electrical circuit and stops rotation of a traction sheave upon a resistance of the electrical circuit exceeding a predetermined limit.

2. The rope according to claim 1, wherein said at least one load bearing member is embedded in a transparent coating forming a surface of the rope.

3. The rope according to claim 1, wherein the capsules are in the form of hollow fibers.

4. The rope according to claim 1, wherein the composite material further comprises a catalyst substance configured to trigger and/or accelerate polymerization reaction of the monomer substance when the monomer substance is in contact with the catalyst substance.

5. The rope according to claim 1, wherein the monomer substance comprises dicyclopentadiene (DCPD).

6. The rope according to claim 5, wherein the composite material further comprises a catalyst material evenly dispersed in the polymer matrix as agglomerates and surrounding the capsules and the catalyst material triggers and/or accelerates a polymerization reaction of the monomer substance.

7. The rope according to claim 6, wherein the catalyst material comprises ruthenium.

8. The rope according to claim 6, wherein the catalyst material comprises metal carbene complexes.

9. The rope according to claim 1, wherein the reinforcing fibers are carbon fibers.

10. The rope according to claim 1, wherein the polymer matrix comprises epoxy.

11. The rope according to claim 1, wherein the reinforcing fibers are continuous fibers, extending substantially throughout the whole length of the rope.

12. The rope according to claim 1, wherein the reinforcing fibers are parallel with a longitudinal direction of the rope, and the capsules are in a form of hollow fibers oriented parallel with the reinforcing fibers.

13. The rope according to claim 1, wherein the capsules are in a form of hollow fibers and substantially shorter than the reinforcing fibers.

14. An elevator comprising:

an elevator car; and a roping comprising one or more ropes connected to the car, wherein the one or more ropes comprises:

at least one continuous load bearing member extending in longitudinal direction of the rope throughout the length of the rope, the load bearing member being made of composite material comprising reinforcing fibers embedded in a polymer matrix, wherein substantially the entirety of the at least one continuous load bearing member is parallel with the longitudinal direction of the rope and is untwisted and substantially the entirety of the reinforcing fibers are parallel with the longitudinal direction of the rope and are untwisted, wherein the composite material comprises capsules embedded in said polymer matrix, the capsules storing a monomer substance in fluid form, each capsule comprising a wall delimiting a closed, hollow inside space in which said monomer substance is stored, each capsule encapsulating the monomer substance in a leakproof manner when the wall of the capsule is intact, wherein an optical indicator substance in fluid form is stored in said capsules and mixed with the monomer substance, the optical indicator substance being substantially different in its optical properties from the optical properties of the polymer matrix and/or the reinforcing fibers, wherein said at least one load bearing member forms part of an electrical circuit, and the reinforcing fibers are electrically conducting fibers, whereby the at least one load bearing member is electrically conducting, and the elevator comprises a rope condition monitoring device configured to monitor one or more electrical properties of said circuit, and if a resistance of the electrical circuit exceeds a predetermined limit, the monitoring device brakes a safety circuit of the elevator, wherein the braking the safety circuit applies a brake to a traction sheave of the elevator.

15. A method for condition monitoring of a rope of an elevator comprising an elevator car and a rope connected to the elevator car, wherein the rope comprises at least one continuous load bearing member extending in longitudinal direction of the rope throughout the length of the rope, the load bearing member being made of composite material comprising reinforcing fibers embedded in a polymer matrix, wherein substantially the entirety of the at least one continuous load bearing member is parallel with the longitudinal direction of the rope and is untwisted and substantially the entirety of the reinforcing fibers are parallel with the longitudinal direction of the rope and are untwisted, wherein the composite material comprises capsules embedded in said polymer matrix, the capsules storing a monomer substance in fluid form, each capsule comprising a wall delimiting a closed, hollow inside space in which said monomer substance is stored, each capsule encapsulating the monomer substance in a leakproof manner when the wall of the capsule is intact, wherein an optical indicator substance in fluid form is stored in said capsules and mixed with the monomer substance, the optical indicator substance being substantially different in its optical properties from the optical properties of the polymer matrix and/or the reinforcing fibers, wherein said at least one load bearing member forms part of an electrical circuit, and the reinforcing fibers are electrically conducting fibers, whereby the at least one load bearing member is electrically conducting, and the elevator comprises a rope condition monitoring device, the method comprises the step of:

monitoring, via the rope condition monitoring device, one or more electrical properties of the electrical circuit, locating point(s) of rupture in the rope based on a change on at least the monitored electrical property of the load bearing member; and inspecting the condition of the rope at the point(s) of rupture, wherein if a resistance of the electrical circuit exceeds a predetermined limit, braking a safety circuit of the elevator via the rope condition monitoring device to apply a brake to a traction sheave of the elevator.

16. The method according to claim 15, wherein the point(s) of rupture in the rope is/are also located by identifying point(s) with deviating optical properties from the optical properties of the polymer matrix and/or the reinforcing fibers.

* * * * *